US005934539A

United States Patent [19]

Lee

[11] Patent Number: 5,934,539

[45] Date of Patent: Aug. 10, 1999

[54] ADJUSTABLE NAILER MAGAZINE

[76] Inventor: Yun-Chung Lee, 8F-4 No.26 Wu-Chuan 2nd Road, Shin-Chuang City, Taipei Hsien, Taiwan

[21] Appl. No.: 09/226,922

[22] Filed: Jan. 6, 1999

[51] Int. Cl.[6] ..... B25C 1/04

[52] U.S. Cl. ..... 227/109; 227/120

[58] Field of Search ..... 227/109, 119, 227/120

[56] References Cited

U.S. PATENT DOCUMENTS

| | | | |
|---|---|---|---|
| 4,728,021 | 3/1988 | Kennedy | 227/109 |
| 5,522,533 | 6/1996 | Mukoyama et al. | 227/109 |
| 5,653,371 | 8/1997 | Hou | 227/109 |
| 5,704,532 | 1/1998 | Wey | 227/109 |
| 5,743,453 | 4/1998 | Chuang | 227/109 |

*Primary Examiner*—Scott A. Smith
*Attorney, Agent, or Firm*—Pro-Techtor International Services

[57] ABSTRACT

An adjustable nailer magazine for storing nails to be ejected from a nailer, comprising: a magazine body, with a groove cut inside the magazine body for accommodating the nails in a row, the groove having a lower part, an upper part and a depth that determines a length of the nails; an adjusting device for adjusting the depth of the groove, mounted in the magazine body and having a plurality of adjusting plates, which are placed parallel to and above each other, oriented perpendicular to the nails; an outer adjusting cap on the outer side of the magazine body, which is glidingly movable, driving the adjusting device; and a pushing device, mounted in the magazine body, for pushing the nails towards one end of the magazine body. By moving the outer adjusting cap, the adjusting plates are placed one after another over the groove, reducing the depth thereof in various stages, thus allowing to vary the length of nails placed in the groove. The pushing bar further comprises a first pushing bar with a first pushing plate, gliding in the lower part of the groove, and a second pushing bar with a second pushing plate, gliding in the upper part of the groove between two of the plurality of adjusting plates, such that relatively long nails are stably supported while being pushed.

4 Claims, 8 Drawing Sheets

ADJUSTABLE NAILER MAGAZINE

BACKGROUND OF THE INVENTION

1. Field of the Invention

The present invention relates to an adjustable nailer magazine, particularly to an adjustable nailer magazine for housing nails of variable lengths in a row.

2. Description of Related Art

Conventional nailer magazines are mostly capable of housing nails of one length only. For working with nails of various lengths, several nailers have to be prepared, which is inconvenient. To compensate for this shortcoming, nailer magazines for nails of various lengths have appeared on the market.

As shown in FIGS. 2 and 3, a conventional nailer magazine for nails of various lengths has a magazine body 1 with a front end and a groove 2 along a horizontal direction for accommodating nails 8. The nails 8 are pushed towards the front end of the magazine body 1 by a pushing plate 7. An adjusting plate 3 is inserted in the groove 2, glidingly movable in a vertical direction and having levers 4, which point in an oblique direction. A gliding plate 5 is inserted in the magazine body 1, glidingly movable along the horizontal direction. The gliding plate 5 has at least one driving shaft 6, serving as an axis for the levers 4 on the adjusting plate 3. When the gliding plate 5 moves in the horizontal direction, the adjusting plate 3 is shifted upward or downward, driven by the levers 4. Thus the depth of the groove 2 is varied, and nails of varying lengths are accommodated therein.

However, this arrangement has disadvantages. As shown in FIG. 3, in order to accommodate the adjusting plate 3 inside the magazine body 1, the maximum length of nails in the groove 2 is reduced or the magazine body 1 has to be more voluminous and is thus less convenient to use. Furthermore, as shown in FIG. 4, because the adjusting plate 3 occupies some height inside the groove 2, the pushing plate 7 has to be designed with reduced height to avoid interfering with the adjusting plate 3. Consequently, the nails 8 are not held stably while pushed forward. Especially long nails are only supported on a lower part, with an upper part swaying freely. When the lower parts of the nails 8 move forward, the upper parts easily stay back, the nails 8 tilt and are stuck within the magazine body 1, unable to be used in the nailer.

SUMMARY OF THE INVENTION

It is therefore an object of the present invention to provide an adjustable nailer magazine with reduced volume.

Another object of the present invention is to provide an adjustable nailer magazine with increased stability of pushing the nails forward and thus with increased reliability.

The present invention can be more fully understood by reference to the following description and accompanying drawings.

DETAILED DESCRIPTION OF THE PREFERRED EMBODIMENT

Figure 1:
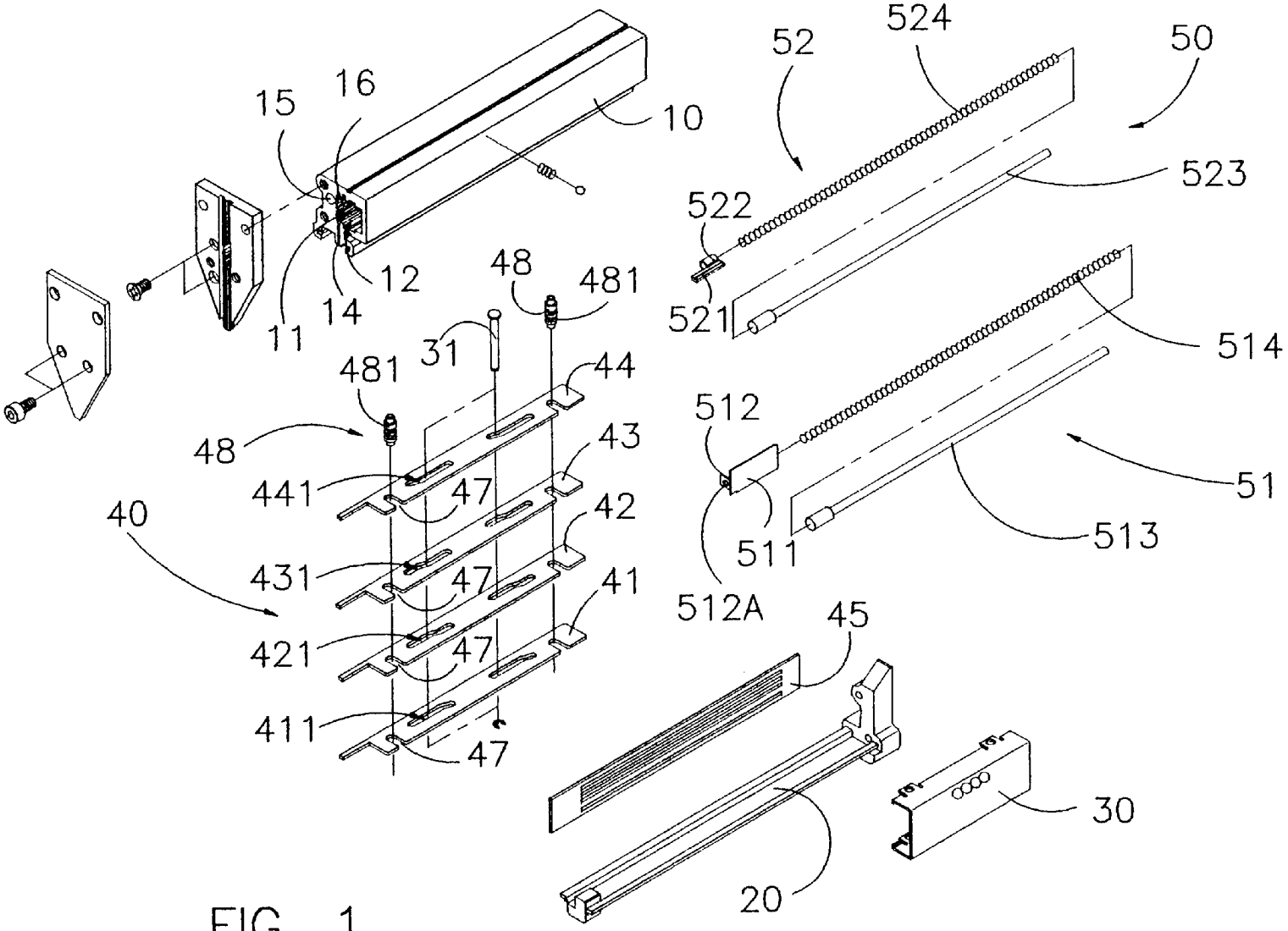
FIG. 1 is an exploded perspective view of the adjustable nailer magazine of the present invention.
Figure 3:
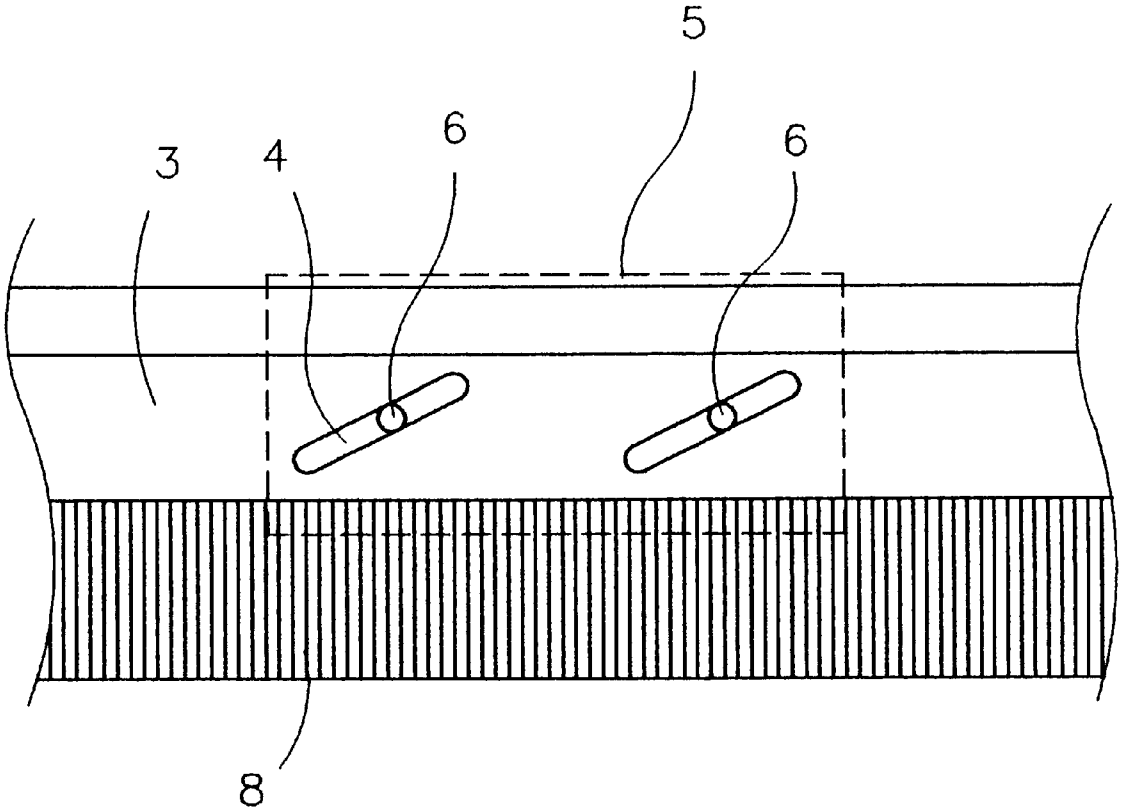
(PRIOR ART) FIG. 3
FIG. 3 (prior art) is a longitudinal sectional view of a conventional adjustable nailer magazine.
Figure 2:
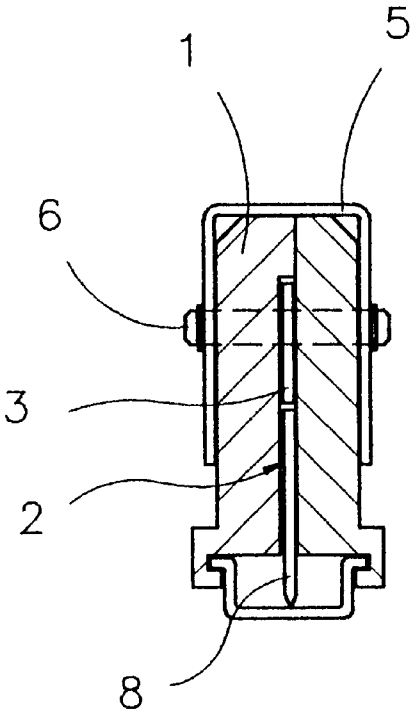
(PRIOR ART) FIG. 2
FIG. 2 (prior art) is a cross-sectional view of a conventional adjustable nailer magazine.
Figure 4:
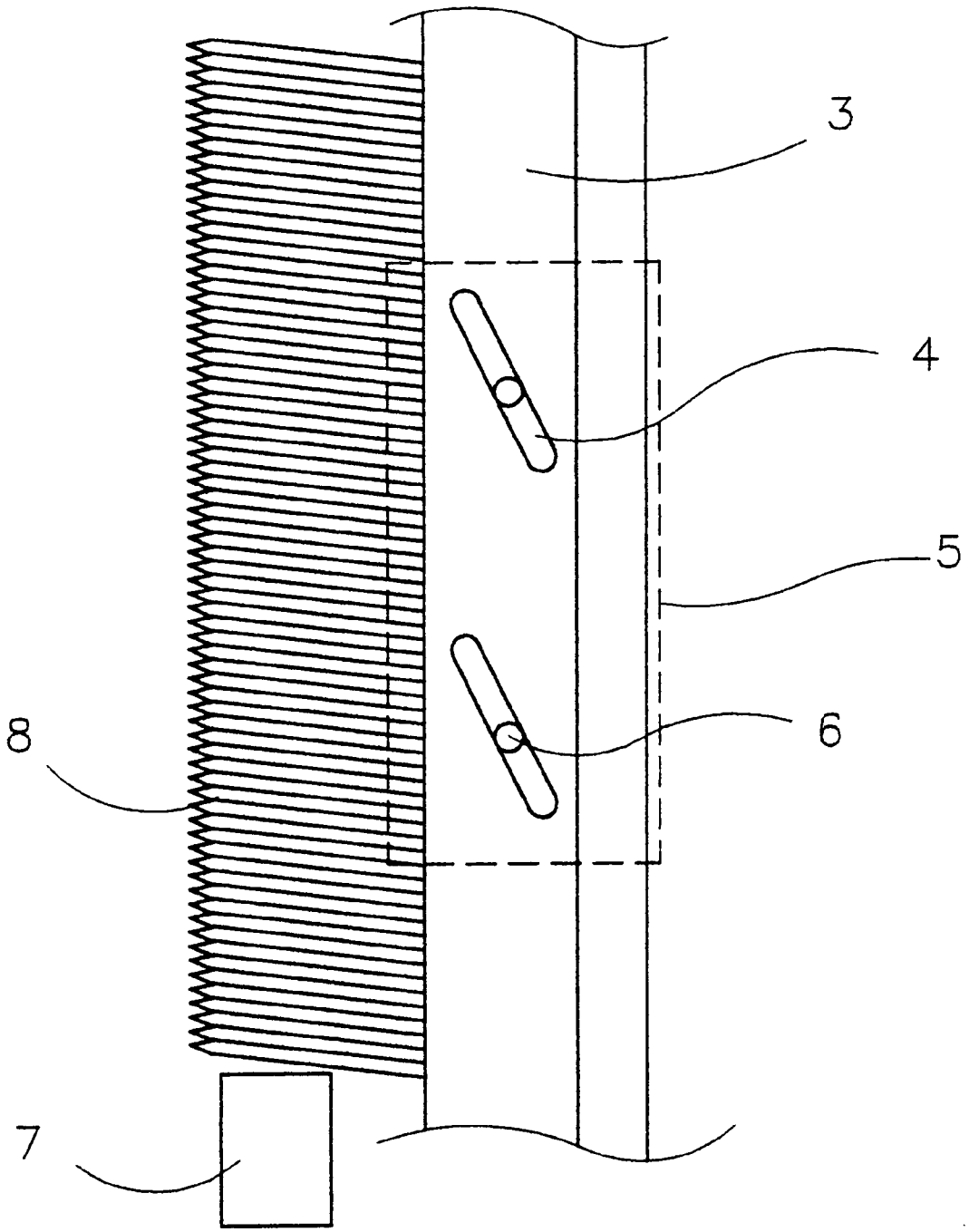
(PRIOR ART) FIG. 4
FIG. 4 (prior art) is a schematic illustration of a conventional adjustable nailer magazine, filled with relatively long nails that are not held stably while pushed forward.

The adjustable nailer magazine of the present invention is used in a nailer for storing and preparing nails to be ejected. As shown in FIG. 1, the adjustable nailer magazine of the present invention mainly comprises: a magazine body 10 with an outer side, a front end and a rear end; a gliding body 20 inserted into the magazine body 10 through the rear end thereof and carrying the nails; an outer adjusting cap 30 on the outer side of the magazine body 10; an adjusting device 40, mounted inside the magazine body 10; and a pushing device 50.

The front end and the rear end of magazine body 10 define a horizontal, longitudinal direction. The nails in the magazine body are oriented in a vertical direction perpendicular thereto. A transverse direction is defined as perpendicular to the longitudinal and to the vertical direction.

A groove 11 along the longitudinal direction is cut into the inner side of the magazine body for accommodating a row of nails, having a certain height that determines the length of the nails. The gliding body 20 is glidingly movable within the magazine body 10 in the longitudinal direction and, when completely inserted, closes the rear end thereof. The outer adjusting cap 30 is glidingly movable in the longitudinal direction. The adjusting device 40 is driven by the outer adjusting cap 30 for adjusting the height of the groove 11. By adjusting the height of the groove 11, nails of various lengths are accommodated therein. The pushing device 50 pushes the nails towards the front end of the magazine body 10 to be ejected by the nailer.

Figure 5:
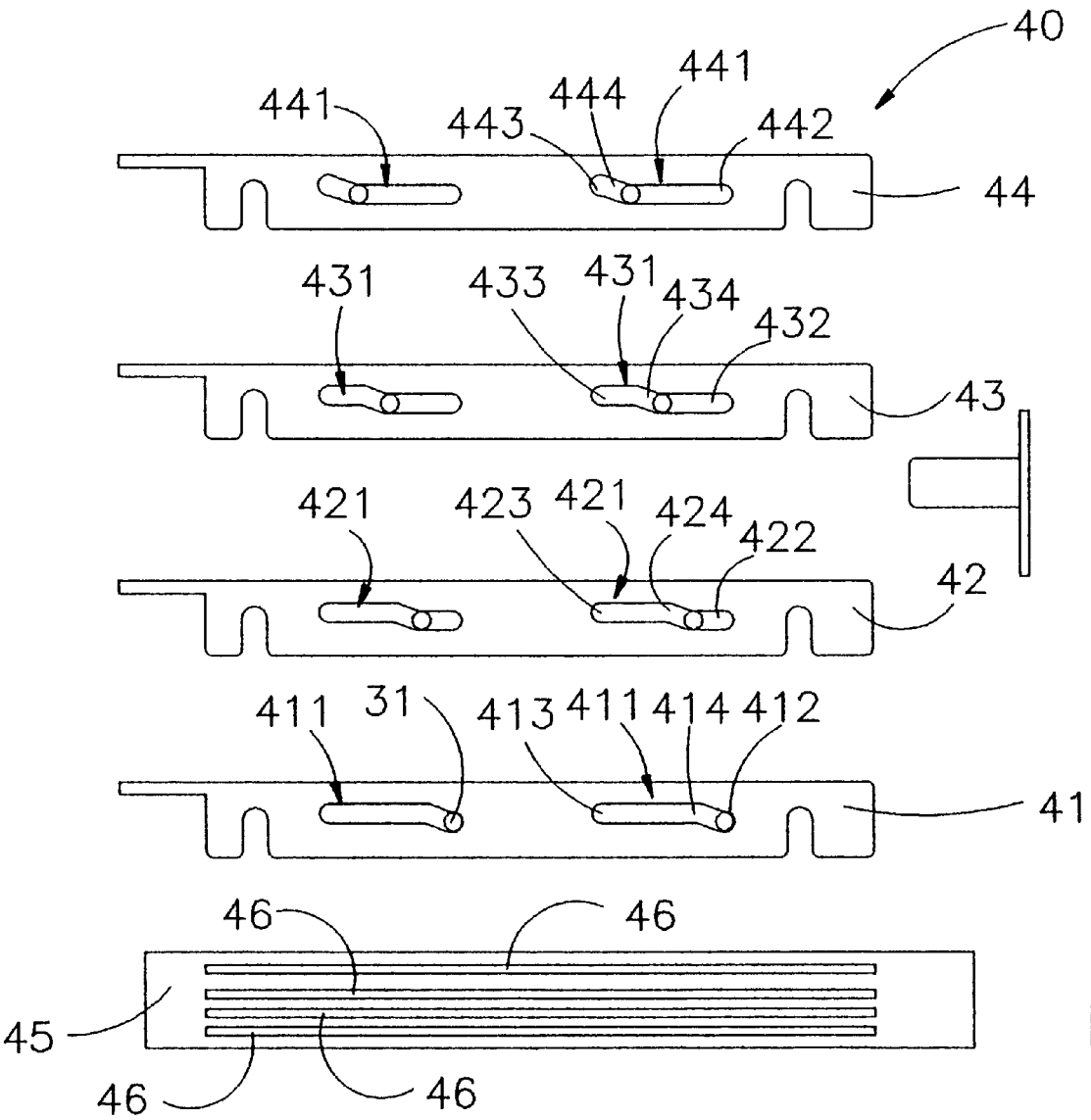
FIG. 5 is a view of the structural parts of the adjusting device of the present invention.

The main characteristic of the present invention lies in the adjusting device 40, as shown in FIGS. 1 and 5. The adjusting device 40 comprises several horizontal adjusting plates 41, 42, 43, 44, which are arranged parallel to each other and above each other in an opening 12 within the magazine body 10. The adjusting plates 41, 42, 43, 44 each have a front end and a rear end and are glidingly movable in the transverse direction, each having two sets of incisions 411, 421, 431, 441. The adjusting plates 41, 42, 43, 44 are held apart by a vertical distancing plate 45, which is mounted inside the magazine body 10. The vertical distancing plate 45 has several longitudinal incisions 46, running along the longitudinal direction. The adjusting plates 41, 42, 43, 44 are inserted in the longitudinal incisions 46 to be supported therein.

The opening 12 has a front end and a rear end, on each of which a vertical guiding pin 48 is mounted. As shown in FIG. 1, each guiding pin 48 has several circular grooves 481. The adjusting plates 41, 42, 43, 44 each have on the front end and on the rear end a U-shaped transverse incision 47 at longitudinal positions that correspond to the guiding pins 48. The incisions 47 are laid around the guiding pins 48, entering the circular grooves 481 thereon to be supported there. Thus the adjusting plates 41, 42, 43, 44 are movable back and forth in the transverse direction.

Figure 6:
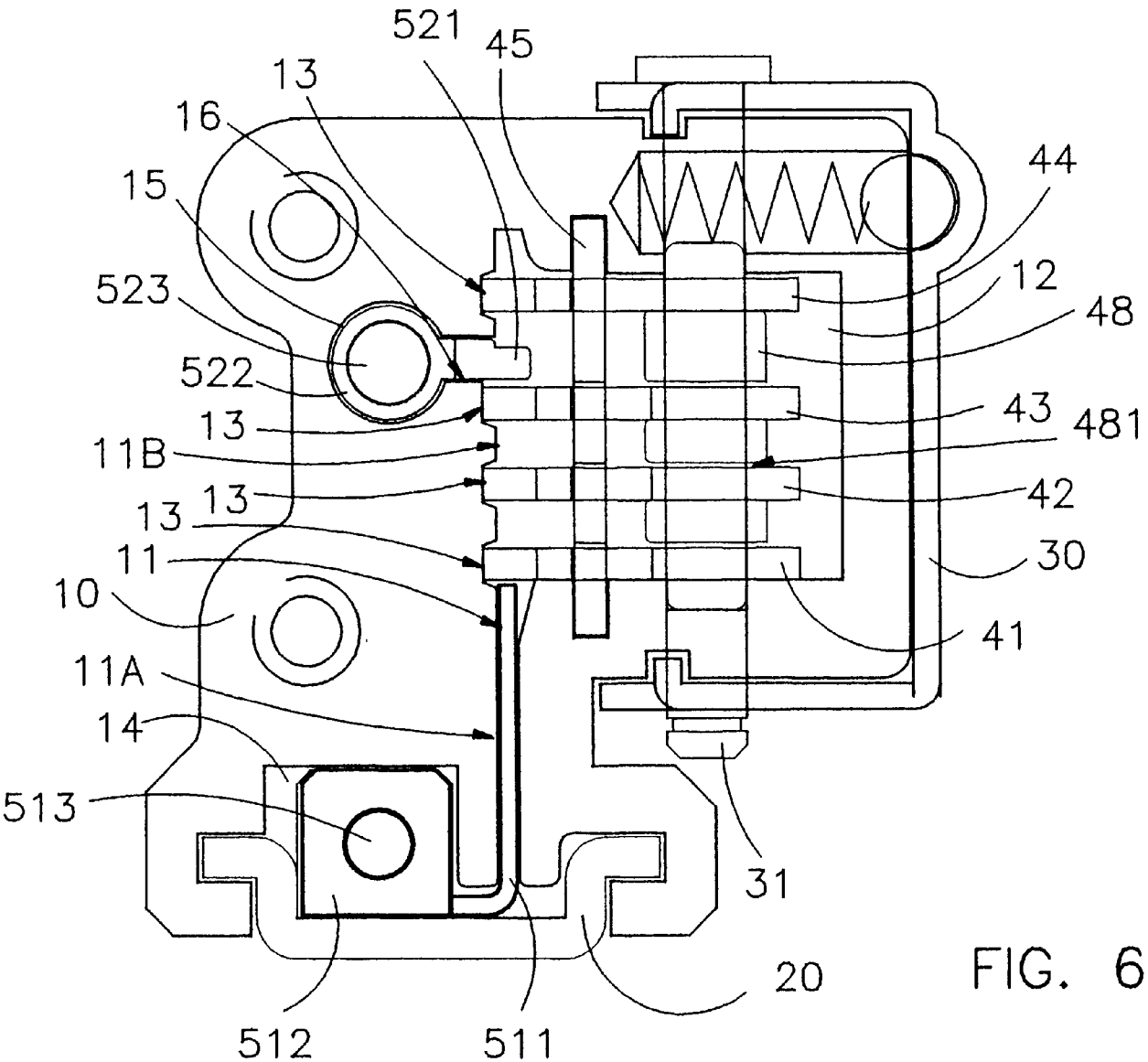
FIG. 6 is a cross-sectional view of the assembled parts of the adjustable nailer magazine of the present invention.
Figure 7:
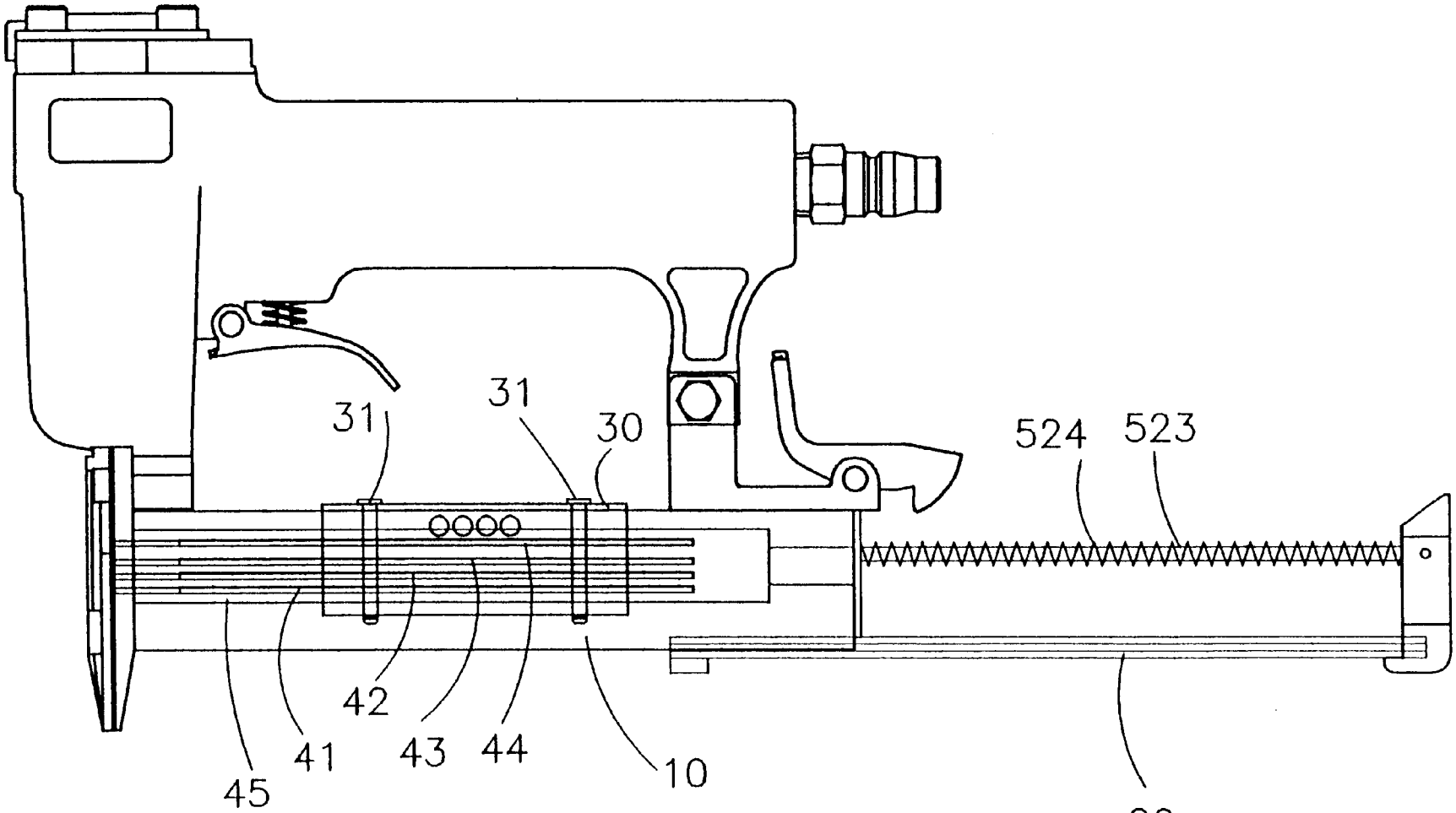
FIG. 7 is a side view of the assembled adjustable nailer magazine of the present invention in conjunction with a nailer.
Figure 9:
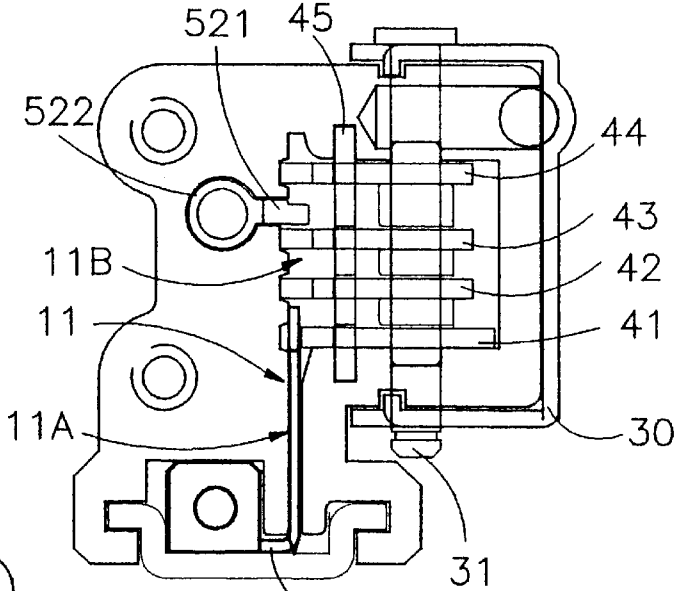
FIGS. 8–12 are cross-sectional views of the assembled parts of the adjustable nailer magazine of the present invention used with nails of various lengths.
Figure 10:
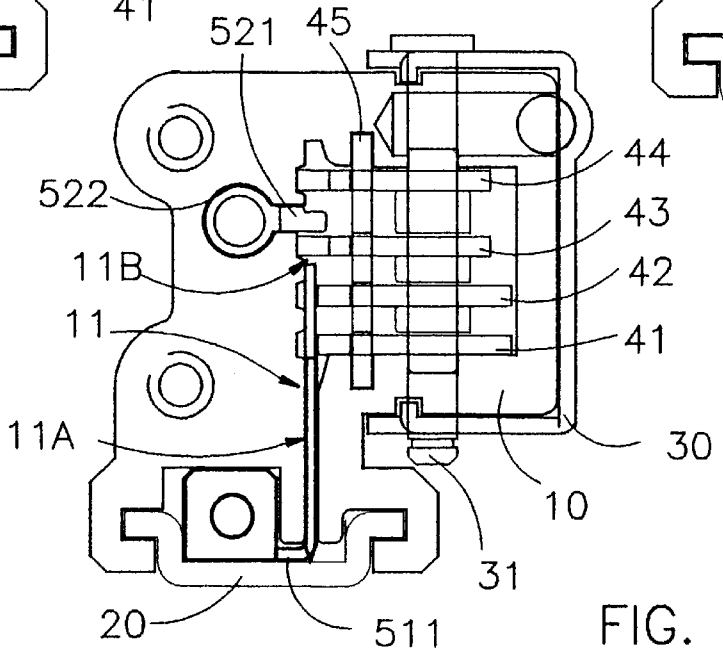
Figure 8:
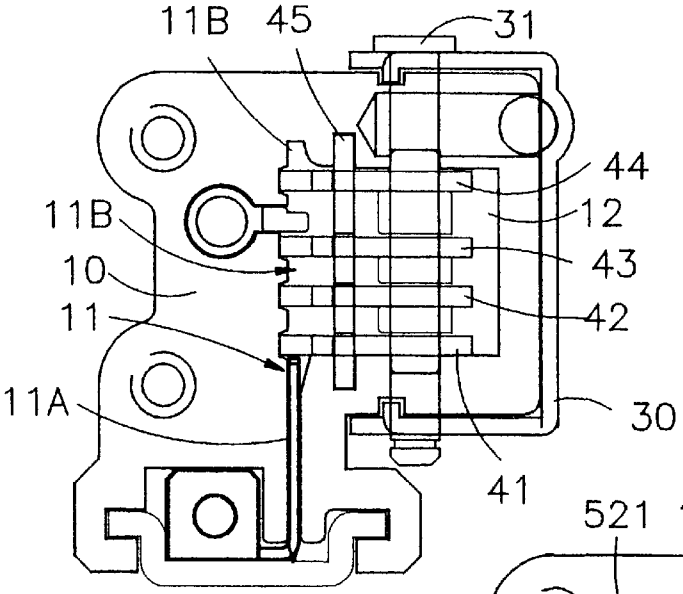

Referring to FIGS. 1, 6 and 7, the outer adjusting cap 30 has two bolts 31, one for each set of incisions 411, 421, 431, 441 in the adjusting plates 41, 42, 43, 44. The bolts 31 pass through the magazine body 10 and the incisions 411, 421, 431, 441 in the vertical direction. The bolts 31 are fixed on the outer adjusting cap 30. The outer adjusting cap 30 is movable back and forth on the magazine body 10 between a foremost position and a rearmost position. When the outer adjusting cap 30 moves, the bolts 31 are taken along, shifting the adjusting plates 41, 42, 43, 44 in the transverse direction according to the shape of the incisions 411, 421, 431, 441.

As shown in FIG. 5, each set of incisions 411, 421, 431, 441 has beginning parts 412, 422, 432, 442 and end parts 413, 423, 433, 443, connected by transition parts 414, 424, 434, 444. The beginning parts 412, 422, 432, 442 are vertically aligned, and the end parts 413, 423, 433, 443 are vertically aligned, as well. However, the beginning parts 412, 422, 432, 442 have a transverse position on the adjusting plates 41, 42, 43, 44 that is different from the transverse position of the end parts 413, 423, 433, 443.

Referring to FIG. 6, the groove 11 has a right wall and an opposite left side, where the adjusting plates 41, 42, 43, 44 are placed. Holding grooves 13 are cut into the right wall of the groove 11. When the outer adjusting cap 30 has been pushed into the foremost position thereof, the bolts 31 sit in the beginning parts 412, 422, 432, 442 of all incisions 411, 421, 431, 441, pushing the adjusting plates 41, 42, 43, 44 towards the right wall of the groove 11, into the holding grooves 13. When the outer adjusting cap 30 has been pushed into the rearmost position thereof, the bolts 31 sit in the end parts 413, 423, 433, 443 of all incisions 411, 421, 431, 441, pulling the adjusting plates 41, 42, 43, 44 out of the holding grooves 13. With some or all of the adjusting plates 41, 42, 43, 44 in the groove 11, the nails therein are held firmly and will not tilt.

As shown in FIGS. 5 and 8–12, the present invention allows to adjust the height of the groove 11. The adjusting plates 41, 42, 43, 44 are positioned at increasing heights, and the transition parts 414, 424, 434, 444 of the incisions 411, 421, 431, 441 have different longitudinal positions. When the outer adjusting cap 30 is pushed away from the foremost position, the bolts 31 enter the transition parts 414, 424, 434, 444 one after another, shifting the adjusting plates 41, 42, 43, 44 one after another away from the right wall of the groove 11, such that the height of the groove 11 is raised in various stages.

In the embodiment of the present invention explained here, the transition part 414 of the adjusting plate 41 is positioned relatively close to the beginning part 412 thereof. The transition parts 424, 434, 444 of the adjusting plates 42, 43, 44 in turn approach the end parts 423, 433, 443. Thus, shifting the outer adjusting cap 30 towards the rear causes the adjusting plates 41, 42, 43, 44 one after another to clear the groove 11, raising the height of the groove 11 in various stages.

The arrangement of the adjusting plates 41, 42, 43, 44 above each other does not require to employ a magazine body of increased height.

Furthermore, the adjusting plates 41, 42, 43, 44 have relatively large mutual distances, allowing to install an additional pushing bar for increased stability of positioning nails of a comparatively large length. The pushing device 50 of the present invention comprises a first pushing bar 51, mounted in the lower half of the magazine body along the longitudinal direction, and a second pushing bar 52, mounted in the upper half of the magazine body along the longitudinal direction, as well, and acting on the upper halves of long nails.

As shown in FIGS. 1 and 6, the first pushing bar 51 comprises: a pushing plate 511, which is a metal plate, inserted in the groove 11 in a lower part 11A below the height of the lowest adjusting plate 41; a guiding plate 512, attached to a side of the pushing plate 511; a guiding bar 513, glidingly moving in the magazine body 10 along the longitudinal direction and having a front end, which passes through a hole 512A in the guiding plate 512; and a helical spring 514 around the guiding bar 513 for pushing the front end thereof with the pushing plate 511 towards the front end of the magazine body 10, thus pushing forward the nails in the groove 11.

Referring again to FIG. 6, the magazine body 10 has an opening 14 for accommodating the guiding plate 512 and the guiding bar 513 with the helical spring 514. The helical spring 514 pushes the guiding plate 512 towards the front end of the magazine body 10. At the same time, the pushing plate 511 pushes the nails in the groove 11 towards the front end of the magazine body 10. Since the pushing plate 511 stays in the lower part 11A of the groove 11, there will be no interference with the adjusting plates 41, 42, 43, 44.

As shown in FIG. 1, the second pushing bar 52 comprises: a pushing plate 521; a guiding plate 522, attached to a side of the pushing plate 521; a guiding bar 523, having a front end, which passes through the guiding plate 522; and a helical spring 524 around the guiding bar 523 for pushing the front end thereof with the pushing plate 521 towards the front end of the magazine body 10.

Referring again to FIG. 6, the magazine body 10 has an opening 15 for accommodating the guiding plate 522 and the guiding bar 523 with the helical spring 524. The opening 15 has a connecting groove 16 for connecting to an upper part 11B of the groove 11, thus allowing the pushing plate 521 to glide therein. The pushing plate 521 of the second pushing bar 52 is vertically positioned between the adjusting plates 43 and 44, gliding in the groove without interfering with the adjusting plates 41, 42, 43, 44.

Figure 12:
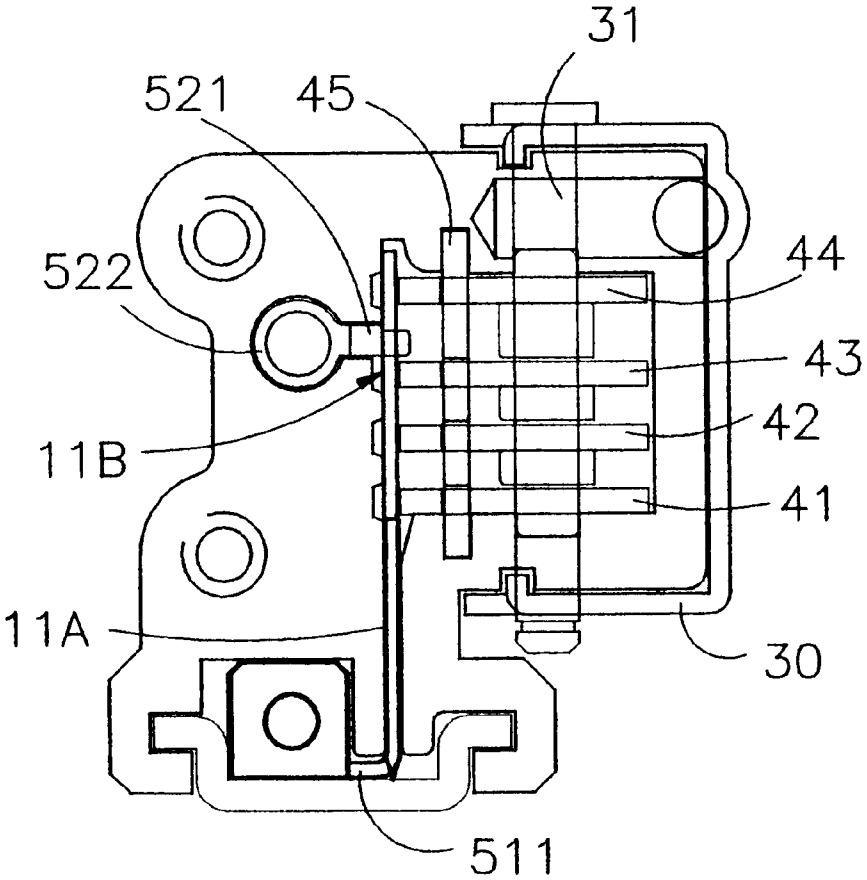
Figure 11:
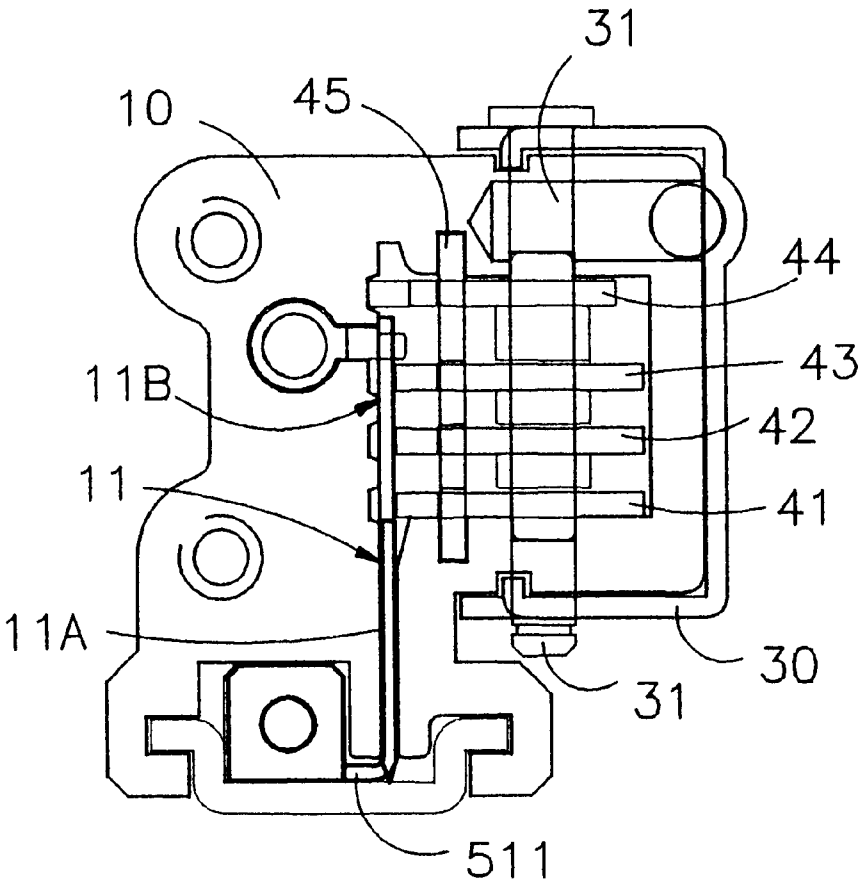

As shown in FIGS. 11 and 12, when long nails are used, taking up some or all of the upper part 11B of the groove 11, the nails are pushed forward not only by the first pushing bar 51, but also by the second pushing bar 52 between the adjusting plates 43 and 44. Thus long nails are stably supported and will keep their orientation while being pushed.

While the invention has been described with reference to a preferred embodiment thereof, it is to be understood that modifications or variations may be easily made without departing from the spirit of this invention which is defined by the appended claims.

I claim:

1. An adjustable nailer magazine for storing nails to be ejected from a nailer, comprising:

a magazine body with an outer side, a front end and a rear end, which define a longitudinal axis, with a groove cut along said longitudinal axis inside said magazine body for accommodating said nails in a row, said groove having a depth that determines a length of said nails, said nails being oriented in a vertical direction;

an adjusting device for adjusting said depth of said groove, mounted in said magazine body and further comprising several adjusting plates, parallel to and above each other, oriented perpendicular to said nails, several guiding elements for guiding said adjusting plates along a transverse direction, which is perpendicular to said longitudinal direction and to said vertical direction, several incisions in said adjusting plates, having oblique shapes, and several bolts, passing through said incisions, driven in said longitudinal direction and, by said oblique shapes of said incisions, driving said several adjusting plates one after another in said transverse direction, such that said several adjusting plates are enabled to cover said groove one after another, reducing said depth thereof in various stages;

an outer adjusting cap on said outer side of said magazine body, which is glidingly movable in said longitudinal direction and connected to said several bolts for driving said adjusting device; and a pushing device, mounted in said magazine body, for pushing said nails towards said front end of said magazine body;

wherein, by moving said outer adjusting cap in said longitudinal direction, said depth of said groove is adjusted, such that said length of said nails to be accommodated therein is varied, and wherein said several adjusting plates are arranged in a way that said magazine body has no increased height.

2. An adjustable nailer magazine according to claim 1, wherein said groove has a lower part and an upper part and said pushing device further comprises:

a first pushing bar, having a first pushing plate gliding in said lower part of said groove; and a second pushing bar, having a second pushing plate gliding in said upper part of said groove between two of said several adjusting plates;

wherein relatively long nails are stably supported while being pushed.

3. An adjustable nailer magazine according to claim 1, wherein said guiding elements further comprise:

a vertical distancing plate, having several longitudinal incisions for supporting said several adjusting plates; and several guiding pins, each having several circular grooves, which support said several adjusting plates on U-shaped incisions and guide said several adjusting plates separately in said transverse direction.

4. An adjustable nailer magazine for storing nails to be ejected from a nailer, comprising:

a magazine body with an outer side, a front end and a rear end, which define a longitudinal axis, with a groove cut along said longitudinal axis inside said magazine body for accommodating said nails in a row, said groove having a lower part, an upper part and a depth that determines a length of said nails, said nails being oriented in a vertical direction;

an adjusting device for adjusting said depth of said groove, mounted in said magazine body and having a plurality of adjusting plates, which are placed parallel to and above each other, oriented perpendicular to said nails;

an outer adjusting cap on said outer side of said magazine body, which is glidingly movable in said longitudinal direction, driving said adjusting device; and a pushing device, mounted in said magazine body, for pushing said nails towards said front end of said magazine body, and further comprising a first pushing bar, having a first pushing plate gliding in said lower part of said groove, and a second pushing bar, having a second pushing plate gliding in said upper part of said groove between two of said plurality of adjusting plates, such that relatively long nails are stably supported while being pushed.

* * * * *